US011791147B2

(12) United States Patent
Chung et al.

(10) Patent No.: US 11,791,147 B2
(45) Date of Patent: Oct. 17, 2023

(54) MASS SPECTROMETER AND METHOD FOR ANALYSING A GAS BY MASS SPECTROMETRY

(71) Applicant: Leybold GmbH, Cologne (DE)

(72) Inventors: Anthony Hin Yiu Chung, Ulm (DE); Thorsten Benter, Gruiten (DE); Michel Aliman, Oberkochen (DE); Rudiger Reuter, Heiligenhaus (DE); Yessica Brachthaeuser, Wuppertal (DE)

(73) Assignee: Leybold GmbH, Cologne (DE)

( * ) Notice: Subject to any disclaimer, the term of this patent is extended or adjusted under 35 U.S.C. 154(b) by 0 days.

(21) Appl. No.: 17/280,694

(22) PCT Filed: Aug. 12, 2019

(86) PCT No.: PCT/EP2019/071577
§ 371 (c)(1),
(2) Date: Mar. 26, 2021

(87) PCT Pub. No.: WO2020/064201
PCT Pub. Date: Apr. 2, 2020

(65) Prior Publication Data

US 2022/0005682 A1 Jan. 6, 2022

(30) Foreign Application Priority Data

Sep. 27, 2018 (DE) ..... 102018216623.4

(51) Int. Cl.
*H01J 49/24* (2006.01)
*H01J 49/04* (2006.01)
*H01J 49/40* (2006.01)

(52) U.S. Cl.
CPC ..... *H01J 49/0468* (2013.01); *H01J 49/0422* (2013.01); *H01J 49/24* (2013.01); *H01J 49/401* (2013.01)

(58) Field of Classification Search
CPC .... H01J 49/0468; H01J 49/0422; H01J 49/24; H01J 49/401; H01J 49/0027
(Continued)

(56) References Cited

U.S. PATENT DOCUMENTS 4,039,828 A 8/1977 Pokar et al.
5,308,979 A * 5/1994 Villa-Aleman ..... 250/288
(Continued)

FOREIGN PATENT DOCUMENTS

DE 19820626 A1 11/1999
DE 102013201499 A1 7/2014
(Continued)

OTHER PUBLICATIONS

European Examination Report dated May 13, 2019 for corresponding European application Serial No. 102018216623.4, 7 pages.
(Continued)

*Primary Examiner* — Michael Maskell
(74) *Attorney, Agent, or Firm* — Theodore M. Magee; Westman, Champlin & Koehler, P.A.

(57) ABSTRACT

The invention relates to a mass spectrometer for analysing a gas by mass spectrometry, comprising: a controllable inlet system for pulsed feeding of the gas to be analysed from a process region outside the mass spectrometer into an ionisation region, an ionisation device for ionising the gas to be analysed in the ionisation region, an ion transfer device for transferring the ionised gas from a ionisation region via an ion transfer region into an analysis region, and an analyser for detecting the ionised gas in the analysis region. The invention further relates to an associated method for mass spectrometrically analysing a gas.

29 Claims, 2 Drawing Sheets

(58) Field of Classification Search
USPC ..... 250/281, 282, 288
See application file for complete search history.

(56) References Cited

U.S. PATENT DOCUMENTS

| | | | | |
|---|---|---|---|---|
| 5,311,016 | A | 5/1994 | Villa-Aleman | |
| 6,646,253 | B1 * | 11/2003 | Rohwer | H01J 49/0422 239/3 |
| 2013/0048851 | A1 | 2/2013 | Kumano et al. | |
| 2014/0138540 | A1 | 5/2014 | Ouyang et al. | |
| 2015/0108346 | A1 | 4/2015 | Ouyang et al. | |
| 2016/0111269 | A1 * | 4/2016 | Fedosenko | H01J 49/145 250/288 |

FOREIGN PATENT DOCUMENTS

| | | | | |
|---|---|---|---|---|
| DE | 102014226038 | A1 | 6/2016 | |
| EP | 0474741 | B1 * | 12/1996 | |
| EP | 0770870 | A2 | 5/1997 | |
| JP | 2000137025 | A | 5/2000 | |
| JP | 2002541629 | A | 12/2002 | |
| JP | 2016126013 | A * | 7/2016 | G01N 30/14 |
| JP | 2018098113 | A | 6/2018 | |
| WO | 9014587 | A1 | 11/1990 | |
| WO | 2013104583 | A2 | 7/2013 | |
| WO | 2014118122 | A2 | 8/2014 | |
| WO | 2015003819 | A1 | 1/2015 | |
| WO | 2016096457 | A1 | 6/2016 | |

OTHER PUBLICATIONS

PCT International Search Report dated Oct. 23, 2019 for corresponding PCT application No. PCT/EP2019/071577, 3 pages.
PCT Written Opinion dated Oct. 23, 2019 for corresponding PCT application No. PCT/EP2019/071577, 5 pages.
Japanese Notice of Reasons for Refusal dated Feb. 8, 23 for corresponding Japanese application Serial No. JP2021-517800, 20 pages.

* cited by examiner

MASS SPECTROMETER AND METHOD FOR ANALYSING A GAS BY MASS SPECTROMETRY

CROSS-REFERENCE OF RELATED APPLICATION

This application is a Section 371 National Stage Application of International Application No. PCT/EP2019/071577, filed Aug. 12, 2019, which is incorporated by reference in its entirety and published as WO 2020/064201 A1 on Apr. 2, 2020 and which claims the priority of the German patent application DE 10 2018 216 623.4 filed Sep. 27, 2018, of which the entire disclosure is made the content of this application through reference.

BACKGROUND

The invention relates to a mass spectrometer for analysing a gas by mass spectrometry. The invention also relates to a method for the mass spectrometry analysis of a gas by means of a mass spectrometer, in particular by means of a mass spectrometer as described above.

The etching of semiconductors (dry etch) is a chemically complex procedure in which heavily corrosive gases are used. In order to be able to optimise these processes, methods of analysis are sought, in particular real-time methods, for observing the etching process and thus to be able to draw conclusions about the reactions taking place. It is furthermore advantageous to examine the respective ongoing process in respect of a drift or deviation from a standard process. It is also of great interest to identify when an end point of the etching process is reached, through a change in the etched material and thus a change in the reaction products. Similar questions also arise in the case of coating processes.

From WO 2013/104583 A2, an apparatus has become known for the surface treatment (coating or etching treatment) of a substrate, this apparatus having a process gas analyser with an ion trap as well as with an ionisation device for ionising a gaseous constituent of a residual gas atmosphere, which is arranged in a chamber for the surface treatment of the substrate. The process gas analyser can have a controllable inlet for the pulsed feeding of the gaseous component that is to be detected. The ionisation device is situated upstream of the controllable inlet. The ionised gas components can be fed to the process gas analyser or ion trap via a feed device, e.g. in the form of an ion lens, possibly in combination with a vacuum tube.

In process chemistry, caustic, highly corrosive gases are likewise often used or produced, which have to be gauged in the manufacture of a product or in the course of quality control. Mass spectrometers with a pulsed inlet, such as are described in WO 2013/104583 A2, are advantageous for the analysis of such corrosive gas mixtures where long service life and high sensitivity are required simultaneously. The pulsed gas inlet can be combined with various types of analysers/detectors or mass spectrometers which are operated both in a pulsed manner and continuously, for example quadrupole mass spectrometers, triple quadrupole mass spectrometers, Time-of-Flight (TOF) mass spectrometers, scanning ion trap mass spectrometers, as well as FT (Fourier Transform) mass spectrometers, in particular FT-IT (ion trap) mass spectrometers, such as for example linear ion traps (linear ion trap, LIT), 3D quadrupole ion traps (quadrupole ion trap, QIT), Orbitraps, and so on.

In the analysis of corrosive gases, the gas flow from the process to the analyser should be as low as possible, in order to minimise damage to the analyser in which the ionised gas is detected.

Opposing this is the requirement that one wishes to bring as much gas as possible into the analyser in order to achieve good sensitivity, since in order to exceed the detection limit of the analyser, one needs a minimum number of analyte ions, which in turn are produced from the neutral gas components.

In order to avoid corrosion to the analyser, attempts are made to keep the pressure in the area of the analyser or in the analysis area as low as possible. This is customarily achieved by reducing the gas flow into the mass spectrometer so heavily that the small quantity of gas cannot cause any significant degradation of the analyser within an acceptable time period. To this end, the ionisation in an ionisation area and the detection in an analysis area can be spatially separated, with the ionisation taking place in the ionisation area at a higher pressure, and the ions for detection being transferred into the analysis area in which a lower pressure prevails.

Even where there is no spatial separation between the ionisation area and the analysis area because the gas that is to be analysed is ionised directly in the analyser or in the analysis area, reducing the pressure compared with the process pressure makes sense, particularly if the process pressure is comparatively high. Process pressure here means the pressure in the receiving vessel or in the process area, which contains the gas that is to be analysed and which is located outside the mass spectrometer.

From WO 2014/118122 A2 the practice is known on ionising a gas mixture that is to be investigated directly in a detector, for example in an ion trap, to which are fed the gas mixture and ions and/or metastable particles of an ionisation gas that are produced by an ionisation device, for example a plasma ionisation device.

WO 2015/003819 A1 likewise describes a mass spectrometer with an ion trap for the mass spectrometry investigation of a gas mixture and with an ionisation device which is designed for ionising the gas that is to be investigated in the ion trap. The mass spectrometer can have a controllable inlet for the pulsed feeding of the gas mixture that is to be investigated to the ion trap. The mass spectrometer can also have a pressure-reduction unit with at least one, for example two, three or more modular pressure stages that can be connected in series, in order to reduce the gas pressure of the gas mixture that is to be investigated, before it is fed to the ion trap.

A pressure-reducing device with a vacuum housing with an inlet opening for the intake of a gas that is to be investigated at a process pressure, and with an analysis chamber for the analysis of the gas by mass spectrometry at a working pressure, has become known from DE 10 2014 226 038 A1. The vacuum housing has a plurality of vacuum components with pressure-reduction spaces, which can be connected to one another in a modular manner. A modulator for the pulsed feeding of the gas that is to be investigated into the analysis chamber can be arranged in the area of the inlet opening. For ionisation of the gas that is to be investigated, an ionisation device can be arranged in the analysis chamber and/or can be connected to an analyser arranged in the analysis chamber.

In the case of the mass spectrometers described further above, in which the ionisation of the gas that is to be investigated takes place in the analyser, it is advantageous if a rapid change in pressure takes place, so that the pressure is high only briefly during ionisation, which can be achieved for example by the use of a rapid-switching, controllable valve, via which the gas that is to be investigated is fed into the analyser.

In this case, the gas can be admitted in a controlled manner by opening and closing the valve.

Many other very sensitive mass spectrometers with rapid measurement times, such as e.g. quadrupole mass spectrometers, triple quadrupole mass spectrometers, Time-of-Flight (TOF) mass spectrometers, for example orthogonal acceleration (oa)TOF mass spectrometers and so on, work with the greatest efficiency only when operated with continuous intake of gas. Admittedly, attempts have been made to utilise the latter mass spectrometers under a corrosive gas environment too, but it has been shown that their ion sources were very quickly damaged and rendered unusable by the corrosive gas.

WO 2016/096457 A1 describes a mass spectrometer with an ionisation device in which a chamber for the treatment of the gas that is to be ionised is arranged between a primary inlet and a secondary inlet for a gas that is to be ionised. A pressure reduction of the gas that is to be ionised can take place in that chamber. To this end, the chamber can be pumped differentially or via a valve (in a pulsed manner). Foreign gas suppression, particle filtration and/or particle treatment can also be carried out in the chamber, in order to convert the gas that is to be ionised into a composition that is suitable for supply to the ionisation device. Thermal decoupling can also take place in the chamber, so that the temperature of the gas entering from the environment in the secondary inlet following on from the chamber does not exceed a maximum operating temperature. The thermal decoupling can be effected by means of thermal insulation, passive cooling, active cooling etc.

In summary, conventional mass spectrometers with pulsed intake of gas demonstrate a long service life against corrosive gases, but have only a moderate speed (repetition rate of approx. 10 Hz) and sensitivity (of the order of ppbV (parts per billion by volume)). Conventional mass spectrometers with continuous admission of gas generally have a high speed (repetition rates of up to 10 k Hz) and sensitivity (of the order of <pptV), but have a short service life in a corrosive environment.

The discussion above is merely provided for general background information and is not intended to be used as an aid in determining the scope of the claimed subject matter. The claimed subject matter is not limited to implementations that solve any or all disadvantages noted in the background.

SUMMARY

Task of the Invention

The task of the invention is to provide a mass spectrometer which on the one hand allows great sensitivity and on the other hand allows a long service life in a corrosive environment.

Subject Matter of the Invention

This problem is solved by a mass spectrometer comprising: a controllable inlet system for pulsed feeding of the gas that is to be analysed from a process area outside the mass spectrometer into an ionisation area, an ionisation device for ionising the gas that is to be analysed in the ionisation area, an ion transfer device for transferring the ionised gas from the ionisation area via an ion transfer area into an analysis area, and an analyser for detecting the ionised gas in the analysis area (as well as for analysing the ionised gas by mass spectrometry).

In the case of the mass spectrometer according to this invention, pulsed sampling is carried out, i.e. the gas that is to be analysed is extracted in a pulsed manner from the process area outside the mass spectrometer.

The process area can be located for example in an interior space of a process chamber, in which for example an etching process, coating process, cleaning of the process chamber etc. is carried out.

The controllable inlet system for the gas that is to be analysed, the subsequent ion transfer and the detection or analysis of the gas in the analyser are typically carried out synchronised and periodically. For the synchronisation of the controllable inlet system, the analyser and the extraction device (see below), the mass spectrometer generally has a controller that enables periodic operation of the mass spectrometer. The inlet system is adapted to the respective ionisation and analysis method. The inlet system, ionisation method and analysis method thus become an overall mass spectrometer system.

A controllable inlet system is taken to mean that the inlet system can be switched at least between two states (open/closed). To this end, the inlet system can for example have a rapid-switching, controllable valve. In particular, the valve can be designed to assume the open or closed state e.g. over a time duration of approx. 10 μs to >1 s. The possibility of setting the duration of opening of the valve provides the opportunity to let the gas into the mass spectrometer when data or measured values that are relevant to the process are to be expected. If the end of e.g. an etching process is to be identified, it is already approximately known in advance at what point in time the end point of the etching process will be reached. For that reason, observation of the etching process for the identification of the end point is necessary only in a small time window in which the controllable valve is opened.

In this way, the amount of corrosive gas that is admitted into the mass spectrometer can be heavily reduced and the gas flow of corrosive gases into the analysis area can be reduced to a minimum.

Depending on the analyser that is used, in this way the signal of an ion type or a whole spectrum with signals of several ion types can be recorded. Since the sampling rate or the period duration is known, the useful signal can be markedly amplified by techniques such as e.g. lock-in or multi-channel single-ion counting, so that high-sensitivity detection or analysis of the gas can be achieved. Through the pulsed feeding into the ionisation area, the mass spectrometer can, in particular, also be used advantageously for the analysis of gases that have corrosive gas components, as described in more detail below.

In the case of one embodiment, the controllable inlet system has a tubular, preferably temperature-controllable, replaceable and/or coated component for feeding the gas that is to be analysed into the ionisation area. It has proved to be beneficial if the gas that is to be analysed is fed into the ionisation area via a tubular, particularly a hose-shaped component. In contrast to other components of the mass spectrometer, such a component can, as a rule, be replaced quickly and economically. To this end, the tubular component is typically connected to the ionisation device of the mass spectrometer in a detachable manner. If necessary, together with the tubular component one can also exchange a controllable valve which is fitted to the tubular component. It has likewise proved to be beneficial if the tubular component can be actively temperature-controlled, for example by means of a heating and/or cooling device, e.g. in the form of a Peltier element. In this way, depending on the process that is to be monitored, or on the process to be monitored, or on the analyte, a suitable temperature can be established in the process area in order to reduce or induce condensation or decomposition of the gas that is to be analysed, or of the gas components to be analysed in the inlet system.

The same applies for the provision of a coating on the inner surface of the tubular component: the coating is formed of a material that depends on the process to be monitored or on the gas or gas component that is to be analysed in each case. Here, the material of the coating is chosen such that the neutral molecules or atoms of the gas that is to be analysed, or of the corresponding gas components, can enter the ionisation area unhindered as far as possible, without entering into a chemical reaction with the surface of the inside of the tubular component. It is however alternatively likewise possible to design the surface of the inside of the tubular component or the coating such that a reaction is deliberately induced.

In the case of a further embodiment, the controllable inlet system has a filter device, preferably a tubular component in the form of a corrugated hose, in particular made of stainless steel, for filtering at least one corrosive gas component that is contained in the gas that is to be analysed, in particular for filtering (at least) one corrosive gas. In the case of a process that is to be monitored, in the form of an etching process, it is not absolutely necessary to determine the quantity of the actual corrosive gas, since as a rule this is intentionally supplied to the etching process in a known concentration. It is therefore desirable to prevent or reduce the ingress of the actual corrosive gases into the mass spectrometer. To this end, one can for example use a (passive) filter in the form of an appropriate filter material (absorber), on which the corrosive gas is absorbed and/or which reacts with the corrosive gas, so that it is converted and loses its corrosive effect. It is also possible to use an active filter in the form of a scrubber, in which the gas that is to be analysed is brought into contact with a flow of liquid.

A corrosive gas can be used not only in an etching process for etching a substrate or the like, but can also be used for another purpose, for example for cleaning a process chamber in which the process area is formed.

A filter action can already be achieved if the supply conduit of the controllable inlet is formed of a stainless-steel corrugated hose. Since typically numerous components in the mass spectrometer consist of stainless steel, the stainless steel in the supply conduit or on the stainless-steel corrugated hose can serve as sacrificial material which reacts with the corrosive gas before the latter comes into contact with other components of the mass spectrometer. In contrast to other components in the mass spectrometer, the stainless-steel corrugated hose can be quickly and economically. The stainless-steel corrugated hose also has a large surface-to-volume ratio, so that a little gas can react with a large surface.

In the case of one embodiment, the inlet system has a controllable component, particularly a controllable valve, which preferably can be switched between a first switching state for the pulsed feeding of the gas that is to be analysed into the ionisation area and a second switching state for the pulsed feeding of a carrier gas into the ionisation area. The inlet system can in principle consist of any number of components. Besides the switchable component, which for example can be designed as a valve, the inlet system typically has a feed conduit from the receiving vessel to the switchable component, as well as a further feed conduit for feeding the gas that is to be analysed from the switchable component to the ionisation area. The switchable component can also be, instead of a valve, a modulator, for example in the form of a chopper, which produces gas pulses in the form of molecule packets from a continuous molecular beam.

For preference, the controllable valve is designed as a 3-way valve which can be switched between a first switching state for the pulsed supply of the gas that is to be analysed into the ionisation area, and a second switching state for the pulsed supply of a carrier gas into the ionisation area. In this case, the (rapidly) switchable valve is a 3-way valve. In this case, the inlet system has an additional supply conduit in order to supply the carrier gas to the switchable valve in the second switching state. The carrier gas is typically supplied to the ionisation area in the pulse pauses of the gas that is to be analysed, i.e. whenever no gas that is to be analysed is supplied to the ionisation area. In this way, the operating point of the ionisation device that is used can be kept constant. Moreover, the carrier gas can produce a positive, flushing effect in the ionisation area or in an ionising chamber. As a carrier gas, one can for example use an inert gas.

The ionisation device fundamentally comprises an ionising chamber for ionising the analyte, i.e. gas that is to be ionised, and a primary charge generator. The primary charge generator can for example be an electron source or a filament for producing electrons, a VUV radiation source, a UV laser source or a plasma generator for producing ions as well as electrically excited metastable particles. The primary charge generator can be coupled directly to the ionising chamber and thus act directly on the analyte, or can be connected indirectly to the ionising chamber, for example via at least one pressure stage. If a pressure stage is present, a reactant gas (e.g. $H_2$) can be added, in order to convert what the primary charge generator generates (UVA/UV radiation, electrons, ions, electrically excited or metastable particles) into reactant ions (e.g. $H_3^+$).

These reactant ions are fed to the ionising chamber, in order to produce analyte ions (e.g. $[M+H]^+$) via chemical ionisation there.

In the case of one embodiment, the ionisation device has an electron source, in particular one that can be operated in a pulsed manner, for ionising the gas that is to be analysed in the ionisation area. The electron source typically has a filament (glow wire) that is heated up to high temperatures of e.g. up to 2000° C., in order to produce electrons or an electron beam by means of the Richardson effect. The electron source can for example be operated in a pulsed manner with the aid of deflection units, in order to optimally sample a respective gas pulse, i.e. to produce the electron beam in synchronisation with the inlet system and the extraction device (see below) and to minimise any unnecessary burden on the ionisation area or mass spectrometer by the electron beam.

In the case of a further development, the electron source is surrounded by a heat sink that has an opening for the emergence of an electron beam or electrons. The high temperature of the filament can lead to an unwanted thermolysis of components of the gas that is to be ionised, which can be reduced by the heat sink. The heat sink can be formed of a material that has a high coefficient of thermal conduction, for example metals or metal alloys, such as copper, brass, aluminium or stainless steel, in order to remove the heat from the vicinity of the filament. Ideally, the heat sink surrounds the filament in the manner of a shield against the ionisation area, so that high-energy electrons can reach the ionisation area only through the opening. The heat sink can be surface-treated to increase corrosion resistance, for example through the application of for example additional layers of metal, metal oxide, metal nitride etc.

In another further development, the mass spectrometer is designed to maintain a temperature of less than 100° C. in a temperature-controllable ionisation space of the ionisation device when the electron source is operated. On account of the high temperature of the filament, the electron source produces not only electrons but also heat radiation, which can lead to the problem of thermolysis described above. The heat radiation should therefore be kept away from the ionising chamber, in order to allow a defined temperature or defined temperature range to be set there which, as far as possible, is not influenced by the operation of the electron source. This can be achieved e.g. by means of the shielding described above. Additionally or alternatively, the electron source or the filament can be located at a distance as far as possible from the ionising chamber or, to put it more precisely, from the temperature-controllable ionisation space. To reduce the heating action, a comparatively low emission current of the electron source can be set, which for example is no more than approx. 1 mA. The temperature-controllable ionisation space can be a container that is arranged within the ionising chamber or ionisation area. Alternatively, if necessary the whole ionising chamber can form the temperature-controllable ionisation space. For the temperature control of the ionisation space, the mass spectrometer can for example have a combined heating/cooling device in order to maintain a given temperature or a given temperature range in the ionisation space.

In the case of another further development, the electron source comprises an exchange device for, in particular, the automated exchange of a filament of the electron source, or the electron source is detachably fitted to the mass spectrometer. In the case of high operating pressures, a filament is generally susceptible to burning out. For that reason, it is advantageous if a filament can be exchanged with the aid of an exchange device.

To this end, the exchange device can have a lock system, in order to prevent the pressure in the ionisation area from rising when the filament is replaced. For example, to this end the opening in the heat sink or the shield can be closed during replacement of the filament. In this way, the pressure in the analysis area can be maintained, i.e. the vacuum in the analysis area is not broken when the filament is replaced. Alternatively, the entire electron source can be replaced if the filament burns out.

In the case of a further embodiment, the ionisation device has a plasma generator for producing ions and/or metastable particles of an ionisation gas. The plasma generator can be designed as described in the publication WO 2014/118122 A2 that was cited at the outset, which is made the content of this application in its entirety, through reference. In addition, a field generator can be arranged in the ionisation area, for the production of glow discharge (DC plasma), so that the ionisation area forms a secondary plasma area, as described in WO 2016/096457 A1 that was cited at the outset, which is likewise made the content of this application in its entirety, through reference. Through the ions and/or metastable particles of the ionisation gas, chemical ionisation of the gas that is to be analysed can take place, e.g. through impact ionisation and/or through ionisation by charge exchange. The plasma generator can have a controllable gas inlet, which serves for the pulsed feeding of the ionisation gas into the plasma ionisation device, and thus of the ions and/or metastable particles of the ionisation gas into the ionisation area. The controllable gas inlet can be synchronised with the pulsed inlet system and the extraction device (see below), with the aid of the controller, as is the case with the electron source.

The plasma generator can be coupled directly to an ionising chamber, into which the gas that is to be analysed is introduced for ionisation. As described above, between the plasma generator and the ionising chamber a reaction space (a pressure stage) can be formed, to which a reactant gas is added, in order to convert the ions and/or metastable particles of the ionisation gas into reactant ions, which are transferred into the ionising chamber in order to produce analyte ions through chemical ionisation.

In the case of a further embodiment, the ionisation device has a gas inlet for the continuous or pulsed supply of CI gas (CI=chemical ionisation) into the ionisation area of the ionisation device. The supply can take place controlled by a controller, independently or synchronised with the inlet system. The CI gas can be used for the targeted chemical ionisation. In this case, the ionisation of the analyte does not take place directly via the electron beam; rather, first the CI gas is ionised by the electron beam and then the charges are transferred from the CI gas to the analyte. Through skillful choice of the CI gas, it is thus possible to suppress or exclude, in a targeted manner, the ionisation of matrix components or analyte molecules with a lower or absent reaction cross section (threshold spectroscopy), with the threshold in this case depending on the selected CI gas. If for example matrix gases with high ionising energies are used, e.g. argon or nitrogen, through the choice of an appropriate CI gas which is suitable for charge transfer, one can suppress the formation of large quantities of matrix ions and thus, particularly where an FT ion trap is used, prevent the trap from being overfilled. The situation is analogous for the use of reactant gases that produce reactant ions for protonation; here, the proton affinity of the matrix- and analyte molecules is decisive.

One can for example use argon, methane, isobutane or ammonia as CI gases.

In the case of a further embodiment, the ion transfer device has an ion transfer chamber in which the ion transfer area is formed, with the ion transfer chamber being connected via a diaphragm aperture to the ionisation area, and preferably via a further diaphragm aperture to the analysis area. In the simplest case (e.g. in the case of a residual gas analyser), the ion transfer device is a diaphragm. In a more complex embodiment, the ion transfer device has an ion transfer chamber, which for example can have an ion funnel, a diaphragm, a first multipole for ion cooling, a further diaphragm, a second multipole for cooling and for transportation including filter function, a further diaphragm, a third multipole for guiding the ions, as well as an ion lens for coupling into the analyser. All these pressure stages, separated by a diaphragm in each case, can be pumped differentially, in order to reduce the proportion of neutral gas relative to the proportion of ions. In this way, i.e. through differential pumping of the ion transfer chamber, a pressure differential can be created between the pressure in the analysis area and the pressure in the ionisation area, this difference being of the order of more than 106. The diaphragm apertures that separate the individual pressure stages from one another cannot be arbitrarily small, since otherwise not enough ions could pass through the diaphragm apertures, or else one would have to focus the ions very heavily, which would prove to be unfavourable after the emergence of the ions from the ion transfer chamber.

In the case of a further embodiment, the mass spectrometer has a pump device for creating a pressure in the analysis area and for creating a pressure in the ionisation area, with the pump device preferably being designed to set the pressure in the ionisation area independently of the pressure in the analysis area.

The ionisation should take place at as high a pressure as possible, in order to obtain high sensitivity in measurement, whereas in the analysis area a low pressure is favourable. The (independent) setting of the pressure in the ionisation area is advantageous, since an optimum gas pressure in the ionisation area depends on the process that is to be monitored, for example on the concentration of the analyte, as well as on the efficiency of the ionisation of the respective analyte.

The pump device can have a first (vacuum) pump for pumping the analysis area and a second (vacuum) pump for pumping the ionisation area, in order to enable the pressure in the ionisation area to be set independently of the pressure in the analysis area. Alternatively, the pump device can have a so-called split-flow pump, i.e. a pump that has two or more outlets to create two different gas pressures in the analysis area and in the ionisation area. The effective pump output or pressure in the two areas can be set e.g. through the choice of pump (pump output) or through adjustment of geometry. In static terms, this can be effected by adjusting the pump cross section (diameter of the connection between the vacuum chamber and the pump). Dynamic adjustment is possible for example through the use of control valves or parallel switching of valves of different conductance.

In the case of a further embodiment, a pressure in the ionisation area is greater than a pressure in the analysis area. For preference, the pressure in the ionisation area is greater than a pressure in the analysis area by a factor of between $10^3$ and $10^6$. As has been described above, it is advantageous to carry out the ionisation at as high a pressure as possible, in order to obtain high sensitivity in measurement. The pressure in the ionisation area can for example be of the order of 1 mbar or above, whilst the pressure in the analysis area for example can be of the order of approx. $10^{-6}$ mbar or less.

In the case of a further embodiment, in the ion transfer area of the ion transfer device a pressure prevails which lies between the pressure in the ionisation area and the pressure in the analysis area, with the pump device preferably being designed to set the pressure in the ion transfer area independently of the pressure in the ionisation area and the pressure in the analysis area. The ion transfer device or ion transfer stage has, besides an ion lens function, the additional function of vacuum-related decoupling of the analysis area from the ionisation area. The ion transfer area can for example have a pressure corresponding approximately to the average (in relation to the pressure exponent) between the pressure in the ionisation area and the pressure in the analysis area. For example, the pressure in the ion transfer area can be approx. $10^{-2}$ mbar-$10^{-4}$ mbar, if the pressures in the ionisation area and in the analysis area are of the magnitude stated above. As a rule, it is necessary to pump the ion transfer area additionally (differentially); here too, for preference, multi-stage split-flow pumps are used, which then have e.g. an adapted inlet opening for the ionisation area, an inlet opening for the ion transfer area and an inlet opening for the analysis area. Here too, the pressures can be set as described above.

In the case of a further embodiment, the mass spectrometer has a controllable extraction device for the pulsed extraction of the ionised gas out of the ionisation area into the ion transfer area. As was described above, the mass spectrometer typically has a controller for synchronising the extraction device with the controllable inlet system and the analyser, in order to enable periodic operation of the mass spectrometer.

In the case of a further development, the extraction device has an electrode arrangement for (pulsed) acceleration and preferably for focusing (or defocusing) the ionised gas in the direction towards the ion transfer area, in particular in the direction towards the diaphragm aperture. The electrode arrangement typically has at least two electrodes, possibly three or more electrodes, between which a voltage can be applied in order to accelerate the gas that is to be ionised along an acceleration section between, respectively, two of the electrodes, and if applicable to focus or defocus it. The electrodes in each case have an opening through which the ionised gas can pass. The diameter of the openings in the electrodes can decrease in the direction towards the ion transfer area or in the direction towards the diaphragm aperture between the ionisation area and the ion transfer area. The diaphragm aperture and the openings of the electrodes are typically arranged along a common line of sight (a straight line), on which the additional diaphragm aperture of the analyser and the ionisation device are also arranged.

Through the pulsed acceleration of the ionised gas, particularly within sub-intervals of a respective measurement time interval in which the controllable inlet system is open, the ionised gas can be extracted in a targeted manner from the ionisation area into the ion transfer area. To this end, an additional alternating voltage can be applied to the electrodes, which generally lies in the radiofrequency range (RF). To this end, the electrodes can also be connected in series in a funnel-shaped arrangement. Depending on the application, an arrangement of the electrodes along a common line of sight can also be a disadvantage, since this allows unimpeded penetration of neutral particles and radiation, e.g. light.

If this leads to problems, arrangement along a line of sight should be avoided.

In the case of one embodiment, the mass spectrometer has a controller for the synchronised actuation of the controllable inlet system and of the extraction device, such that the extraction device does not extract any ionised gas from the ionisation area when the controllable inlet system is closed. Even with a closed inlet system, the analyser can record a mass spectrum or mass spectra that correspond to a background signal (noise signal) of the mass spectrometer. Here, the controller synchronises the controllable inlet system, for example a controllable valve of the inlet system, with the synchronised extraction device. This is advantageous particularly where ionisation of the gas in the ionisation area takes place also with a closed inlet system, i.e. when the ionisation device is operated continuously and is not synchronised with the controllable inlet system synchronised. As described below, it is likewise possible for the ionisation device to be operated in a pulsed manner, so that it is active only when the controllable inlet system is open.

In the case of one embodiment, for the mass spectrometry analysis of the gas, the analyser is designed to compare a mass spectrum that is recorded in at least one measurement time interval with an open inlet system with a mass spectrum that is recorded in at least one measurement time interval with a closed inlet system. As was described above, a background spectrum of the analyser with a closed inlet system can be recorded and compared with the mass spectrum with an open inlet system containing both the background spectrum and the signal spectrum of the gas that is to be analysed.

Through the comparison, the signal-to-noise ratio can be improved. The comparison can for example consist in subtracting the mass spectrum with a closed inlet system from the mass spectrum with an open inlet system (or vice versa). It is understood that other, more complex possibilities for comparing the mass spectra exist besides subtraction.

In the case of one embodiment, the analyser is designed for the continuous analysis of the ionised gas and the controller actuates the extraction device throughout the entire duration of a respective measurement time interval with an open inlet system, for the extraction of the gas from the ionisation area. In the case of a continuously operated analyser, the recording of a mass spectrum can take place continuously throughout the entire duration of a respective measurement time interval. It therefore makes sense to transfer ionised gas out of the ionisation area into the analysis area throughout the entire duration of the measurement time interval too, in order to achieve the greatest possible sensitivity in the analysis.

In the case of a further development, the analyser can be switched between a signal channel with an open inlet system and a background channel with a closed inlet system, and is designed, for the analysis of the gas, to form a resulting mass spectrum from a plurality of measurement time intervals of the signal channel, to form a resulting mass spectrum from a plurality of measurement time intervals of the background channel, and to compare the resulting mass spectra of the signal channel and of the background channel with one another for mass spectrometry analysis of the gas. The continuously operated analyser continuously records mass spectra or accumulates the recorded measurement or intensity values of the detected ionised gas. Through the switching between the signal channel and the background channel, the mass spectra or intensity values recorded respectively with open or closed inlet system can be added up or accumulated.

For the formation of a respective resulting mass spectrum, for example (possibly weighted) average or the sum of the mass spectra or the accumulated intensity values of the respective measurement time intervals of the signal channel or of the background channel can be formed. Through the totalling and the comparison of the resulting mass spectra, the signal-to-noise ratio can be increased. The number of measurement time intervals from which the resulting mass spectrum is formed can be established in advanced. The number can for example be selected such that during the entire time interval from which the resulting mass spectrum is formed, no changes in the composition of the gas that is to be analysed are to be expected, i.e. the time scale on which the process to be analysed proceeds is greater than the time scale in which the resulting mass spectrum is formed. Through the formation of the resulting mass spectra of a given number of measurement time intervals, a moving average can be realised in the analysis. Alternatively, the number of measurement time intervals may not be specified, i.e. the intensity values of all measurement time intervals from the beginning of the measurement onwards are totalled.

In the case of a further embodiment, the analyser is designed for the pulsed analysis of the ionised gas and the controller is designed to actuate the extraction device in a plurality of sub-intervals of a measurement time interval with an open inlet system, for the extraction of the gas from the ionisation area. If the analyser is operated in a pulsed manner, in one and the same measurement time interval the ionised gas can be extracted several times from the ionisation area and supplied to the analyser. In this case, the analyser integrates or totals only via the intensity values which [arise] in the respective sub-interval or, if applicable, in a subsequent (additional) sub-interval in which no ionised gas is extracted from the ionisation area, before extraction takes place once more.

This can for example make sense if the analyser enables a non-destructive detection of the ionised gas that is to be analysed, since in this case, the quantity of gas that is supplied to the analysis area in the respective sub-interval can, if necessary, be analysed several times.

In the case of a further development, the analyser is designed to form a resulting mass spectrum from a plurality of sub-intervals of a measurement time interval with an open inlet system, and to form a resulting mass spectrum from a plurality of sub-intervals of a measurement time interval with a closed inlet system preceding or following the measurement time interval, as well as to compare the two resulting mass spectra with one another for mass spectrometry analysis.

On account of the pulsed operation of the analyser, the measurement time interval of the background channel can also be subdivided into several sub-intervals, in which in each case a mass spectrum of the background channel is recorded. Out of the mass spectra recorded in the respective sub-intervals of the measurement time interval of the background channel, a resulting mass spectrum can be formed which corresponds to the total or the average of the mass spectra recorded in the sub-intervals. The same applies for the mass spectra recorded in (and possibly additionally after) the respective sub-intervals of the measurement time intervals with an open inlet system. In the case of an analyser operated in a pulsed manner, in this example, thus to form a respective resulting mass spectrum one does not total or form an average via the mass spectra of several measurement time intervals, but via several sub-intervals of one and the same measurement time interval. In this way, the signal-to-noise ratio can likewise be improved.

It is understood that the mass spectrometry analysis of the gas in the analyser can also be undertaken in a manner different from the one proposed above. If the recording speed of the mass spectra is not sufficient to record a mass spectrum several times during a measurement time interval, an analyser operated in a pulsed manner can also be operated in the manner described above in connection with the continuously operated analyser. In any event, through the inlet system operated in a pulsed manner or through the pulsed extraction, a signal-to-background differentiation can be carried out that is optimised for a respective type of analyser.

In the case of a further embodiment, the analyser is selected from the group comprising quadrupole analysers, triple quadrupole analysers, Time-of-Flight (TOF) analysers, particularly orthogonal acceleration TOF analysers, scanning quadrupole ion trap analysers, Fourier transform ion trap analysers, i.e. FT-IT (ion trap) analysers. In principle, all conventional types of mass analysers can be coupled to the controllable inlet system or to the controllable ionisation device/extraction device. A respective type of analyser can be coupled to the ionisation device via a respectively suitable ion transfer device, such as for example RF multipoles, RF ion funnels, electrostatic lens systems or combinations of these devices. The mass spectrometer described here can be of a modular construction, i.e. the analyser, the ion transfer device and the ionisation device can be connected to one another in a detachable manner.

In the case of a quadrupole analyser, typically four cylindrical rods are used to undertake mass filtration in a quadrupole field, i.e. only ions with certain mass-to-charge ratios are let through the quadrupole and reach a downstream detector.

In the case of the so-called triple quadrupole analyser, three quadrupoles are arranged one after another. A first quadrupole serves as a mass filter for the selection of a particular type of ions. A second quadrupole serves as a collision chamber for the fragmentation of ions, and a third quadrupole serves as an additional mass filter for the selection of a particular ion fragment. In a further embodiment of the triple quadrupole mass spectrometer, the first quadrupole serves to filter very large ion signals, the second serves as a mass filter, and the third serves to transfer the ions into the detector in a manner that is as free as possible of losses and aberrations.

In the case of a Time-of-Flight analyser, the mass-to-charge ratio of ions is determined on the basis of a measurement of the time of flight in the zero-impact space. To this end, the ions are typically accelerated in an electrical field and detected at the end of the flight path by a detector. In the case of an "orthogonal acceleration" TOF analyser, the acceleration of ions takes place perpendicular to the original direction of propagation of the ions on entry into the analyser.

In the case of the classic quadrupole ion trap (Paul trap, QIT), the ions of the gas that is to be analysed are stored in a quadrupole field which is typically formed between two cap electrodes and an annular electrode. The ions stored in the ion trap can be removed from the ion trap in a targeted manner and fed to a detector that is arranged in the analysis area. To this end, the RF or DC potential between the electrodes can be varied appropriately (scanning), for example in the manner of a ramp or linear function. Here, ions can be removed from the ion trap in an axial direction, and fed to a detector.

In the case of an FT ion trap analyser, the induction current generated on the measurement electrodes through the intercepted ions is detected in a time-dependent manner and amplified.

Subsequently, this time-dependency is transferred, e.g. via a frequency transformation such as e.g. via a (Fast) Fourier transform, into the frequency space and the mass dependency of the resonance frequencies of the ions is used to convert the frequency spectrum into a mass spectrum. Mass spectrometry by means of a Fourier transform can be carried out for the execution of faster measurements in principle with different types of ion trap, with the combination with the so-called Orbitrap being the most frequent. Orbitraps are based on the ion traps introduced by Kingdon. All the types of analysers that have been described can, as a rule, process both pulsed and continuous ion flows; it must be noted here that in each case, the greatest efficiency of the overall spectrometer consisting of an inlet system, ionisation device, ion transfer device and analyser is achieved only where continuously operating analysers (quadrupole, triple quadrupole analysers) are operated with continuously operated inlet, ionisation and transfer stages, and analysers working in a pulsed manner (Time-of-Flight analysers and ion traps) are operated with pulsed inlet, ionisation and transfer stages. In principle, all combinations are possible, albeit only with, to some extent, a drastic loss of performance capacity of the overall system.

The invention also relates to a method for the mass spectrometry analysis of a gas by means of a mass spectrometer, in particular by means of a mass spectrometer as described above, comprising: pulsed feeding of the gas that is to be analysed from a process area outside the mass spectrometer into an ionisation area, ionising of the gas that is to be analysed in the ionisation area, preferably pulsed extraction of the ionised gas out of the ionisation area into an ion transfer area, transfer of the ionised gas out of the ion transfer area into an analysis area, and detection of the ionised gas in the analysis area for the mass spectrometry analysis of the gas or execution of the mass spectrometry analysis of the detected gas.

As was described above in connection with the mass spectrometer, through pulsed gas sampling from the process area it is possible to reduce the amount of corrosive gas, for example etching gas, that comes into contact with components of the mass spectrometer.

In the case of one variant, the method comprises the following: actuation of the controllable inlet and of the extraction device such that the extraction device does not extract any ionised gas from the ionisation area when the controllable inlet system is closed. As was described above, in this way, with a closed inlet system, a mass spectrum or several mass spectra can be recorded which correspond to a background signal (noise signal) of the mass spectrometer.

In the case of another variant, for the mass spectrometry analysis of the gas, at least one mass spectrum that is recorded in at least one measurement time interval with an open inlet system is compared with at least one mass spectrum that is recorded in at least one measurement time interval with a closed inlet system. As was described above in connection with the mass spectrometer, in this way the signal-to-noise ratio can be improved. Depending on continuous or pulsed operation of the analyser, control or mass spectrometry analysis can take place in the manner described above in connection with the mass spectrometer:

In the case of a continuously operated analyser, one can for example extract gas from the ionisation area throughout the entire duration of a respective measurement time interval with an open inlet system.

The analyser can be switched between a signal channel and a background channel, and for the analysis of the gas, from a plurality of mass spectra recorded during a respective measurement time interval of the signal channel it can form a resulting mass spectrum, from a plurality of mass spectra recorded during a respective measurement time interval of the background channel it can form a resulting mass spectrum, and compare the two resulting mass spectra of the signal channel and the background channel with one another for mass spectrometry analysis.

If the analyser is designed for the pulsed analysis of the ionised gas, the extraction device can be actuated in a plurality of sub-intervals during a measurement time interval with an open inlet system, for the extraction of the gas from the ionisation area. From a plurality of sub-intervals within a measurement time interval with an open inlet system, a resulting mass spectrum can be formed. From a plurality of sub-intervals of a measurement time interval with a closed inlet system preceding or following the measurement time interval, likewise a resulting mass spectrum can be formed. The two resulting mass spectra can be compared with one another for mass spectrometry analysis.

Further features and advantages of the invention follow from the following description of design examples of the invention, on the basis of the figures in the drawing which show details of significance for the invention, and from the claims. The individual features can each be realised individually, or in any combination of several of them in the case of a variant of the invention.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Design examples are shown in the schematic drawing, and are explained in the following description.

In the following description of the drawings, identical reference numbers are used for components that are the same or have the same function.

DETAILED DESCRIPTION

Figure 1:
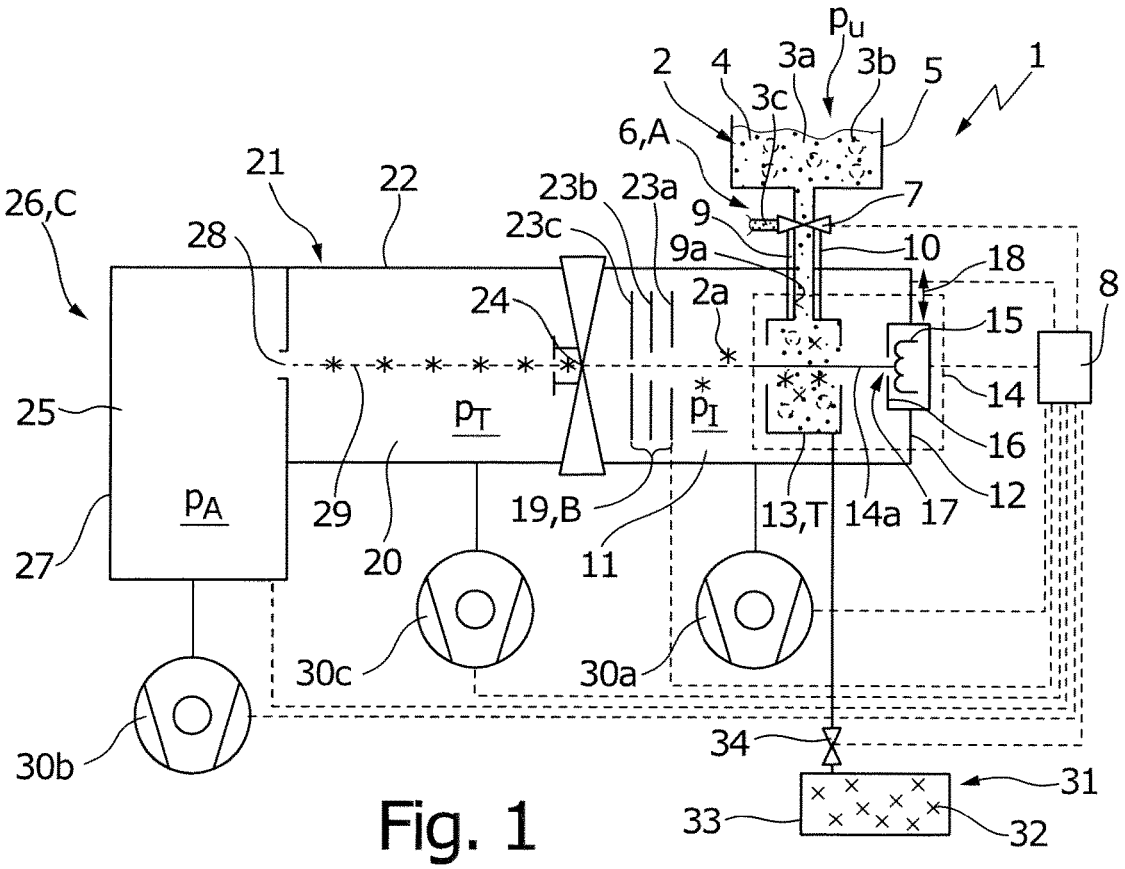
FIG. 1 shows a schematic representation of a mass spectrometer which comprises a controllable inlet system with a switchable valve, an ionisation device with an electron source and with an ionisation space that can be temperature-controlled; a controllable extraction device and an analyser.

Shown schematically in FIG. 1 is a mass spectrometer 1 for the mass spectrometry analysis of a gas 2. The gas 2 has a corrosive gas component 3*a* in the form of a reactive corrosive gas and an etching product 3*b* that is formed when a substrate is etched. The gas 2 is located in a process area 4 outside of the mass spectrometer 1 which forms the interior of a process chamber 5, of which only a part is shown in FIG. 1. The mass spectrometer 1 is connected to the process chamber 5 via an inlet system 6. The connection can be formed for example via a flange.

Instead of a gas 2 which is produced in an etching process, by means of the mass spectrometer 1 one can also analyse a gas 2 which is formed in a coating process, in the cleaning of the process chamber 5, etc.

The inlet system 6 is controllable, i.e. the inlet system 6 has a rapid-switching valve 7, via which the inlet system 6 can be opened or closed. The valve 7 can be actuated with the help of a controller 8. The controller 8 can for example be a data processing system (hardware, software etc.) that is suitably programmed to enable control of the inlet system 6 as well as of other functions of the mass spectrometer 1 (see below).

For the analysis of the gas 2 by mass spectrometry, as a rule it is not necessary to detect the corrosive gas component 3*a*, i.e. the etching gas, since this is supplied to the etching process at a known concentration. The corrosive gas component 3*a* can furthermore damage components of the mass spectrometer 1 through its corrosive action. In order to prevent this, the controllable inlet system 6 has a filter device for filtering the corrosive gas component 3*a*, which in the case of the example shown, is designed in the form of a tubular component, e.g. a stainless-steel corrugated hose 9. The corrugated hose 9 has a comparatively large surface in relation to the volume, and therefore enables the gas 2 to react with the material of the corrugated hose 9 along a large surface.

The corrugated hose 9 is connected to the mass spectrometer 1 in a detachable manner, e.g. by means of a screw connection, so that it can be replaced easily and economically. Through the reaction of the corrosive gas component 3*a* with the corrugated hose material 9, subsequent components of the mass spectrometer 1 that cannot be so easily exchanged as the corrugated hose 9 are protected from the action of the corrosive gas component 3*a*.

The material of the corrugated hose 9 thus serves as sacrificial material.

The corrosive gas component 3*a* can for example be the following gases: Main group VII: halogens (e.g. $F_2$, $Cl_2$, $Br_2$), interhalogens (e.g. FCl, $ClF_3$), haloalkanes (e.g. $CF_4$), hydrogen halides (e.g. HF, HCl, HBr).

Main group VI: halogen oxoacids (e.g. HOCl, $HClO_x$), chalcohalides (e.g. $SF_6$).

Main group V: oxyhalides (e.g. $POCl_3$), hydrides ($PH_3$, $AsH_3$), halides (e.g. $NF_3$, $PCl_3$).

Main group IV: hydrides (e.g. silanes, $Si_nH_m$), halides (e.g. $SiF_4$, $SiCl_4$).

Main group III: hydrides (e.g. boranes $B_nH_m$), halides (e.g. $BCl_3$).

The tubular component in the form of the corrugated hose 9 can be designed, besides for the filter action for the corrosive gas component 3*a*, also to reduce the decomposition or condensation of the gas component 3*b* that is actually of interest, here in the form of the etching product. To this end, the corrugated hose 9 has a coating 9*a* on its inner surface. The material of the coating 9*a* depends on the gas component 3*b* that is to be analysed. For different types of etching products or for different types of etching processes, different types of materials can be used for the coating 9*a*. Different types of corrugated hoses 9 with a respectively adapted coating 9*a* can be kept in reserve, wherein depending on the respective gas component 3*b* that is to be analysed, a respectively adapted corrugated hose 9 is introduced into the mass spectrometer 1. Assigned to the corrugated hose 9 is a temperature-control device 10 in the form of a heating element which heats the corrugated hose 9 up to a temperature that is suitable for the passage of the gas 2 or of the gas component 3*b* that is to be analysed.

The temperature-control device 10 is connected to the controller 8, in order to select the temperature of the corrugated hose 9 to match the type of gas component 3*b* that is to be analysed.

In the case of the example shown in FIG. 1, the switchable valve 7 is designed as a 3-way valve, i.e. via an additional inlet, a carrier gas 3*c* can be supplied to it. The controller 8 is configured to switch the 3-way valve 7 between a first switching state and a second switching state. In the first switching state, the gas 2 that is to be analysed is fed to the ionisation area 11, whereas in the second switching state the carrier gas 3*c* is fed to the ionisation area 11. To this end, the carrier gas 3*c* is fed to the switchable valve 7 via an additional supply conduit, and in fact in the pulse pauses in which no gas 2 that is to be analysed is fed to the ionisation area 11. The ionisation area 11 is thus supplied with the gas 2 that is to be analysed and the carrier gas 3*c* in alternation. In this way, the operating point of the ionisation device that is used (see below) can be kept constant. Moreover, the carrier gas 3*c* can create a positive, flushing action in the ionisation area 11. As a carrier gas 3*c*, one can for example use an inert gas.

Via the controllable inlet system 6 with the tubular component 9 in the form of the corrugated hose, the gas 2, ideally only the gas component 3*b* that is to be analysed, enters into an ionisation area 11, which forms the interior of an ionising chamber 12 of the mass spectrometer 1. The corrugated hose 9 ends in a schematically indicated, temperature-controllable ionisation space 13 (container) which is open at two sides and which is part of an ionisation device 14 that serves to ionise the gas 2 in the ionisation area 11. In the example shown in FIG. 1, the ionisation device 14 has an electron source 14 with a filament (glow wire) 15.

The ionisation device 14 is in signalling connection with the controller 8, in order to actuate a deflector device, not shown in the illustration, for example an electrode arrangement to create an electrical field, in order to intermittently deflect an electron beam 14*a* emerging from the filament 15, so that it cannot pass through an opening 17 in a shield 16 surrounding the filament 15 and into the container 13, in order to ionise the gas 2. The electron source 14 can thus be operated in a pulsed manner, i.e. an electron beam 14*a* is beamed into the ionisation area 11 only if this is expedient for the mass spectrometry analysis of the gas 2, as described in more detail below.

In the example shown, the shield 16 of the filament 15 is designed as a heat sink, i.e. it is made of a material with a high coefficient of thermal conduction, for example copper, brass, aluminium or stainless steel (in each case with a coating, if applicable), in order to draw heat away from the vicinity of the filament 15. The heat sink 16 or shield also enable the vicinity of the filament 15 to be separated from the ionisation area 11, i.e. it is connected to the ionisation area 11 only via the opening 17. Through the heat sink 16, it is made possible for the temperature-controllable ionisation space 13 or ionisation container to be kept at a desired temperature T or desired temperature interval even with the electron source 14 switched on. The temperature T or temperature range in the temperature-controllable ionisation space 13 can for example be less than approx. 100° C., but higher temperatures are also possible. For the temperature control, the ionisation device 14 typically has a heating and/or cooling device, not shown.

The heat sink or shield 16 is advantageous if the filament 15 is to be exchanged with the aid of an exchange device 18 indicated by a double arrow, ideally in an automated manner.

For the exchange of the filament 15, the exchange device 18 can have a transport device for transporting the filament 15 to a replacement position, at which the filament 15 can be exchanged in an automated manner or manually. In order not to break the vacuum or low pressure in the mass spectrometer 1 while the filament 15 is being exchanged, the exchange device 18 can have a lock. If necessary, a diaphragm can serve as a lock, which seals the opening 17 in the heat sink 16 so that the interior of the heat sink 16 is no longer connected to the ionisation area 11. Alternatively, if necessary the entire electron source 14 including the heat sink 16 can be exchanged, if this is a detachable component of the mass spectrometer 1.

As can likewise be seen in FIG. 1, the mass spectrometer 1 also has a controllable extraction device 19 for the pulsed extraction of the ionised gas 2*a* from the ionisation area 11 into an ion transfer area 20 of an ion transfer device 21, this area being formed in an ion transfer chamber 22. In the example shown, the extraction device 19 has an electrode arrangement with three electrodes 23*a-c* for the pulsed acceleration and, if applicable, focusing of the ionised gas 2*a* in the direction towards the ion transfer area 20. The extraction device 19 or the three electrodes 23*a-c* are in signalling connection with the controller 8, in order to apply a desired potential to the electrodes 23*a-c* and in this way to produce a desired acceleration voltage between adjacent electrodes 23*a-c*, in order to extract (in a pulsed manner) the ionised gas 2*a* with a suitable acceleration (dependent on mass-to-charge ratio) from the ionisation area 11 into the ion transfer area 20.

For the passage of the ionised gas 2*a*, the electrodes 23*a-c* each have a central diaphragm aperture. The diameter of the respective openings in the electrodes 23*a-c* decreases in the direction towards the ion transfer area 20, in order to concentrate the ionised gas 2*a* on a diaphragm aperture 24 in a chamber wall, which is formed between the ion transfer chamber 22 and the ionisation chamber 12.

The ion transfer device 21 has an ion lens, not shown, in order to transfer the ionised gas 2*a*, as far as possible without contact, into an analysis area 25 of an analyser 26. The ion transfer area 20 is connected to the analysis area 25, or more precisely to a wall of an analysis chamber 27, via a further diaphragm aperture 28. The diaphragm aperture 24, the further diaphragm aperture 28 and the openings in the electrodes 23*a-c*, or more precisely their respective midpoints, lie on a line of sight 29 (i.e. in a straight line).

The mass spectrometer 1 comprises a pump device in the form of at least two, or three vacuum pumps 30*a,b,c* as shown in the example, which can be actuated independently of one another, by means of the controller 8. Alternatively, the pump device can be designed as a multi-stage split-flow pump. In this way, a pressure $p_I$ in the ionisation area 11 can be set independently of a pressure $p_A$ in the analysis area 25. This is advantageous, since particularly the pressure $p_I$ in the ionisation area 11 is to be set depending on the gas 2 that is to be analysed, and thus on the process that is to be monitored by means of the mass spectrometer 1. In the example shown, the ion transfer device 21 is likewise pumped differentially by a vacuum pump 30*c*. In this way, a static pressure $p_T$ forms in the ion transfer area 20, which lies between the pressure $p_A$ in the analysis area 25 and the pressure $p_I$ in the ionisation area 11. Thus the neutrals in the ion transfer area 20 are pumped out as efficiently as possible and the ionised gas 2*a* is transferred into the analysis area 25 with as little loss as possible.

It has proved to be advantageous if the pressure $p_A$ in the analysis area 25 and the pressure $p_I$ in the ionisation area 11 have a large difference in pressure. The pressure $p_I$ in the ionisation area 11 can for example—depending on the ionisation method chosen—be greater than the pressure $p_A$ in the analysis area 25 by a factor lying between $10^3$ and $10^6$.

The pressure $p_I$ in the ionisation area 11 can be smaller, by a factor of $10^2$, possibly $10^3$, than a pressure $p_U$ in the process area 4 in the process chamber 5. For example, the pressure $p_U$ in the process area 4 can be approx. 1000 mbar, the pressure $p_I$ in the ionisation area 11 can be approx. 1 mbar, the pressure $p_T$ in the ion transfer area 20 can be approx. $10^{-3}$ mbar and the pressure $p_A$ in the analysis area 25 can be approx. $10^{-6}$ mbar or below. In order to be able to maintain these pressure differences and in order to make the diaphragm apertures between the pressure stages, for example the diaphragm aperture 24 between the ionisation area 11 and the ion transfer chamber 22, or the additional diaphragm aperture 24 between the ion transfer chamber 22 and the analysis area 25, as large as possible and thus to be able to make it as transparent as possible for ions, the ion transfer device 21, or more precisely the ion transfer chamber 22, is in most cases pumped. In particular, field generators, e.g. in the form of multipoles, can be arranged in the ion transfer chamber 22, in order to transport the ions into the analysis area 25 with as little loss as possible, and to pump out neutral particles as efficiently as possible, so that they do not get into the analysis area 25.

The mass spectrometer 1 shown in FIG. 1 has an additional gas feed 31 for the continuous or pulsed supply of CI gas 32 from a gas reservoir 33 into the ionisation area 11, or more precisely into the temperature-controllable ionisation space 13. The gas reservoir 33 stands as an example for a device for providing the CI gas 32, wherein supply e.g. via a conduit is likewise possible. The additional gas feed 31 has a further valve 34 for controlling the inflow of the CI gas 32, and is controlled via the controller 8. The CI gas 32 serves for the targeted chemical ionisation in the temperature-controllable ionisation space 13. In this case, ionisation does not take place directly via the electron beam 14*a*; rather, first the CI gas 32 is ionised by the electron beam 14*a* and then—possibly with a time offset—the charges are transferred from the CI gas 32 to the gas component 3*b* that is to be analysed.

Figure 2:
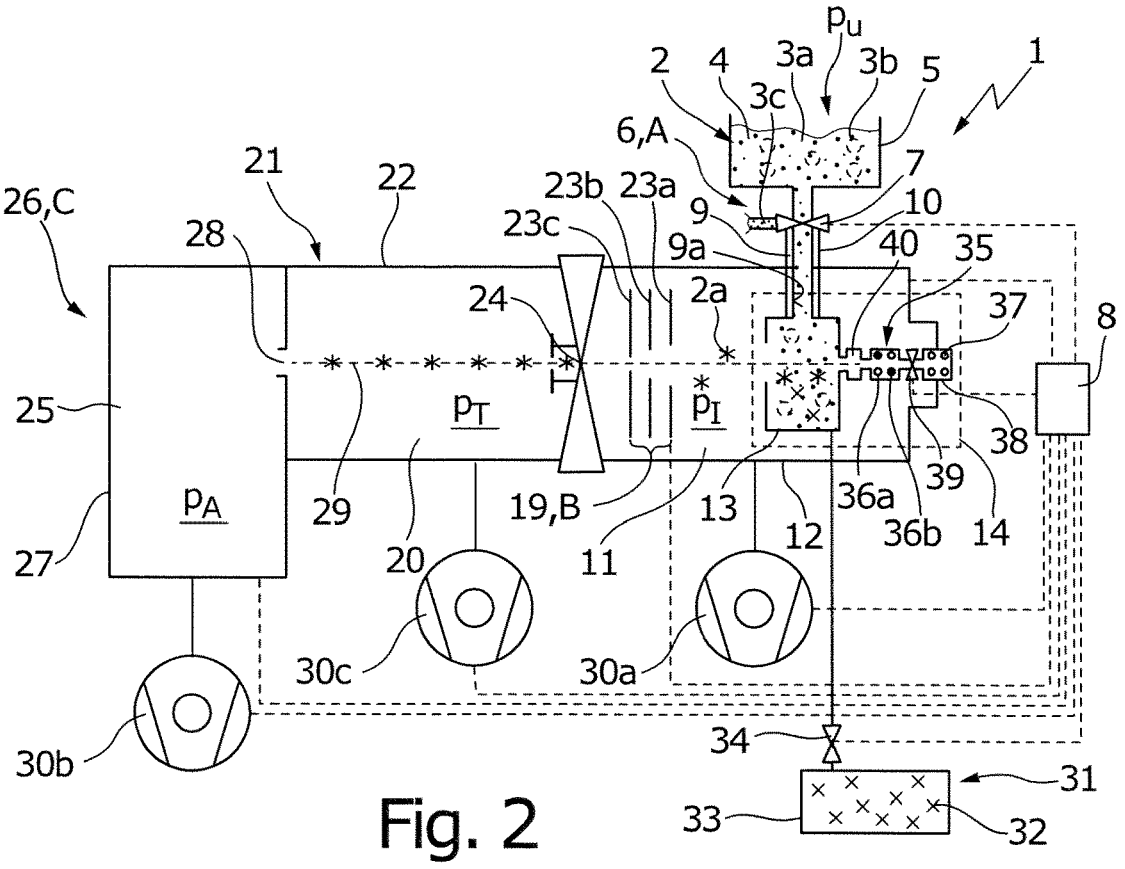
FIG. 2 shows a schematic representation analogous to FIG. 1 with an ionisation device which has a plasma ionisation device.

FIG. 2 shows a mass spectrometer 1 which is designed like the mass spectrometer 1 shown in FIG. 1 and differs only in the type of ionisation device 14: the ionisation device 14 has a plasma ionisation device 35 for producing ions 36*a* and/or metastable particles 36*b* of an ionisation gas 37. The ionisation gas 37, which can for example be a noble gas, e.g. helium, is stored in a gas reservoir 38 and can be supplied via a controllable gas inlet 39 to the plasma ionisation device 35. The ions 36*a* and the metastable particles 36*b* of the ionisation gas 37 emerge from the plasma ionisation device 35 and enter the ionisation area 11, in order to ionise the gas 2 that is to be analysed through impact ionisation and/or through charge exchange ionisation. The ionisation device 14 shown in FIG. 2 can also be operated in a pulsed manner, in that the controllable gas inlet 39 is opened or closed with the aid of the controller 8, with the controllable gas inlet 39 typically only being opened when the inlet system 6 for feeding the gas 2 that is to be ionised 2 into the ionisation area 11 is also opened.

In the case of the ionisation device 14 shown in FIG. 2, the ions 36*a* and the metastable particles 36*b* of the ionisation gas 37 are transferred into a reaction space 40 in which a pressure prevails that lies between the pressure in the plasma ionisation device 31 and the pressure in the ionisation space 13. A reactant gas, e.g. hydrogen, is supplied to the reaction space 40. The gas flow into the reaction space 40 and the respective diameters of the entry and exit diaphragms establish the pressure in the reaction space 40.

The reactant gas is transformed by the ionisation gas 37 through impact ionisation and/or charge exchange into reactant ions, e.g. into $H_3^+$. Via the exit diaphragm of the reaction space 40, these enter the ionisation space 13 within the ionisation area 11, where through chemical ionisation they produce the analyte ions, e.g. $[M+H]^+$, of the analyte M.

The analyser 26 that serves for detecting the ionised gas 2*a* or the components of the ionised gas 2*a* can be designed in various ways: for example, this can be a quadrupole analyser, a triple quadrupole analyser, a Time-of-Flight (TOF) analyser, e.g. an orthogonal acceleration TOF analyser, a scanning quadrupole ion trap analyser, a Fourier transform ion trap analyser, for example an FT-IT) (ion trap) analyser or another type of conventional analyser 26.

Figure 3:
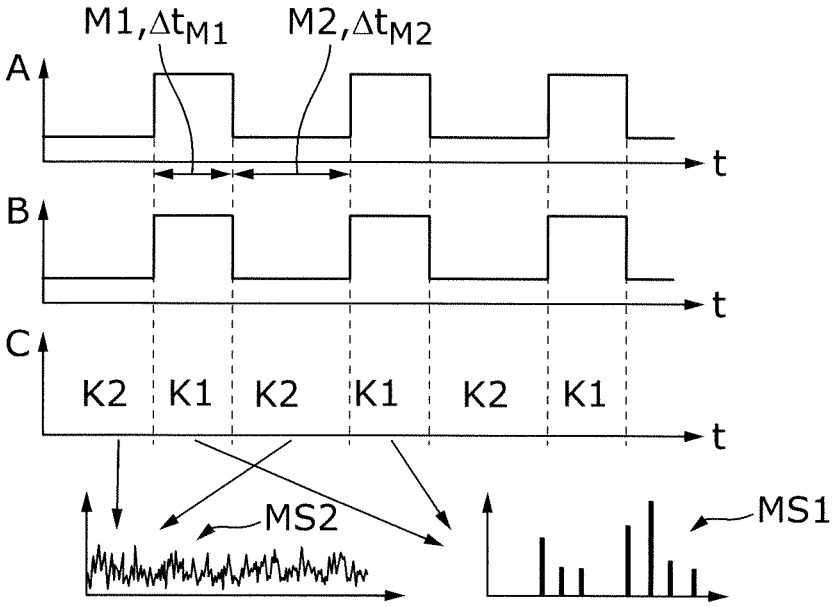
FIG. 3 shows schematic representations of the time progression of the actuation of the pulsed inlet, of the extraction device, and of a continuously operated analyser.

FIG. 3 shows an example of the time progression for the actuation of the pulsed inlet 6 ("A" in FIG. 3, top), the extraction device 19 ("B" in FIG. 3, in the middle), and the continuously operated analyser 26 ("C" in FIG. 3, bottom). Here, the analyser 26 is synchronised with the pulsed inlet system 6 and the extraction device 19 by means of the controller 8. As can be seen in FIG. 3, at the top, the controllable inlet system 6 is periodically switched between am opened switching state (upper signal level in FIG. 3, top) during the first measurement time interval M1 (duration $\Delta t_{M1}$) and a closed switching state (lower signal level in FIG. 3, top) during the second measurement time interval M2 (duration $\Delta t_{M2}$). The duration of the first and second measurement time intervals M1, M2 can be chosen to be the same or different, with the duration $\Delta t_{M1}$, $\Delta t_{M2}$ of the measurement time intervals M1, M2 typically being in the order of microseconds to seconds.

The extraction device 19 is actuated synchronised with the controllable inlet system 6, i.e. it is likewise actuated during the duration $\Delta t_{M1}$ of a respective first measurement time interval M1 (upper signal level in FIG. 3, middle) and switched off during the duration $\Delta t_{M2}$ of a respective second measurement time interval M2 (lower signal level in FIG. 3, middle). The analysis area 25 is thus not supplied with any ionised gas 2*a* from the ionisation area 11 when the controllable inlet system 6 is closed. By contrast, when the inlet system 6 is opened, throughout the entire duration $\Delta t_{M1}$ of a respective first measurement time interval M1, ionised gas 2*a* is taken or extracted from the ionisation area 11 and supplied to the analysis area 25.

As can be seen in FIG. 3, at the bottom, the analyser 26 is periodically switched between a first measurement channel K1 (signal channel) with first measurement time intervals M1 and a second measurement channel K2 (background channel) with second measurement time intervals M2, and in fact simultaneously with the switching over of the controllable inlet 6 and the extraction device 19. In the case of the continuously operated analyser 26, a resulting mass spectrum MS1 is formed from measurement signals, or mass spectra are formed from a given number of first measurement time intervals M1. Accordingly, a resulting mass spectrum MS2 is formed from measurement signals, or mass spectra are formed from a given number of second measurement time intervals M2. The resulting mass spectra MS1, MS2 represent the sum of the measurement signals that are continuously recorded in the respective measurement time intervals M1, M2. In the example shown, the resulting mass spectrum MS1, MS2 is in each case formed from two measurement time intervals M1, M2 of the signal channel K1 and the background channel K2, but it is understood that the number of measurement time intervals M1, M2 that are used for the summation is generally greater, and is set depending on the speed of the process carried out in the process chamber 5. If applicable, the summation can also take place over all measurement time intervals M1, M2 from the start of the measurement.

To form the resulting mass spectra MS1, MS2, in place of a summation one can also form a—possibly weighted—average from the measured values recorded in the respective measurement time intervals M1, M2.

For the mass spectrometry analysis of the gas 2, the resulting mass spectrum MS1 recorded in the signal channel K1 is compared with the resulting mass spectrum MS2 recorded in the background channel K2, or to put it more precisely, the resulting mass spectrum MS2 recorded in the background channel K2, which is attributable to background noise, is subtracted from the resulting mass spectrum MS1 recorded in the signal channel K1. The mass spectrum MS1 that is recorded in the signal channel K1 has a signal portion that corresponds to the mass-to-charge ratios von ionised gas components contained in the gas 2 that is to be analysed, as well as a noise portion that is not shown in FIG. 3, for simplification. In the simplest case, in the comparison, the mass spectrum MS2 of the background channel K2 is subtracted from the mass spectrum MS1 of the signal channel K1, in order to improve the mass-to-charge ratio. It is understood that the comparison between the two mass spectra MS1, MS2 need not be limited to a mere subtraction, but if applicable, more complex links between the two mass spectra MS1, MS2 can be carried out in order to improve the signal-to-noise ratio.

Figure 4:
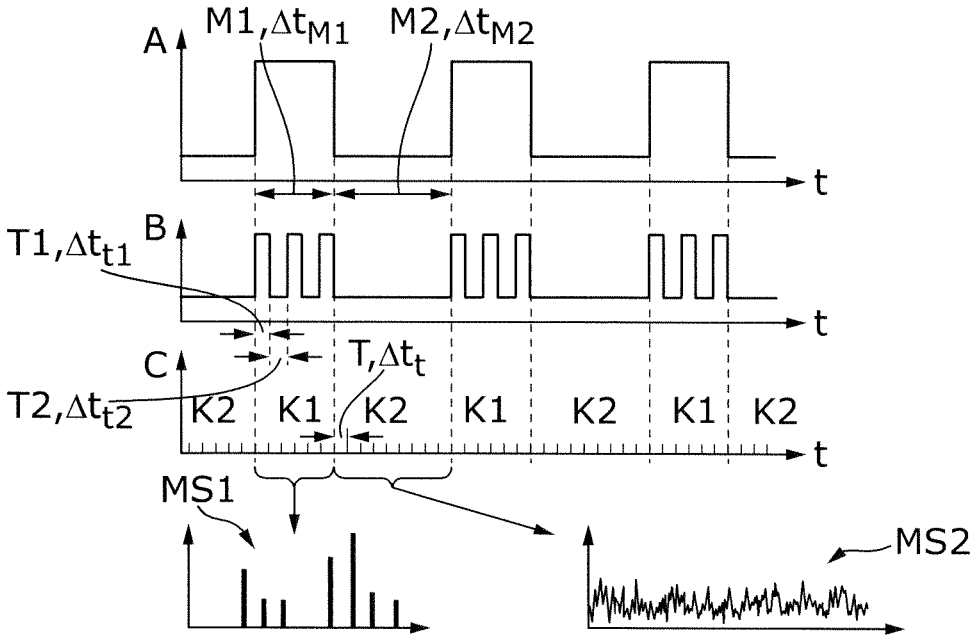
FIG. 4 shows schematic representations analogous to FIG. 3, in the case of an analyser operated in a pulsed manner.

Analogously to FIG. 3, FIG. 4 shows the time progression for the actuation of the pulsed inlet 6 ("A" in FIG. 4, top), the extraction device 19 ("B" in FIG. 4, in the middle), and an analyser 26 that is operated in a pulsed manner ("C" in FIG. 4, bottom). Here, the analyser 26 is likewise synchronised with the pulsed inlet system 6 and the extraction device 19 by means of the controller 8. As can be seen in FIG. 4 at the top, the controllable inlet system 6 is periodically switched between an open switching state (upper signal level in FIG. 4, top) during first measurement time intervals M1 (duration $\Delta t_{M1}$) and a closed switching state (lower signal level in FIG. 4, top) during second measurement time intervals M2 (duration $\Delta t_{M2}$).

The extraction device 19 is actuated synchronised with the controllable inlet system 6, i.e. it is activated only during the duration $\Delta t_{T1}$ of a respective first sub-interval T1 of a first measurement time interval M1 (upper signal level in FIG. 4, middle), whereas the extraction device 19 is inactive during the duration $\Delta t_{T2}$ of a respective second sub-interval T2 of a respective first measurement time interval M1, so that no ionised gas 2*a* can enter from the ionisation area 11 into the analysis area 25. The number of first/second sub-intervals T1, T2 of a respective first measurement time interval M1 can vary depending on the speed of the analyser 26, and can e.g. be ten or more. As in FIG. 3, in FIG. 4 too no ionised gas 2*a* is supplied to the analysis area 25 when the controllable inlet system 6 is closed during a corresponding second measurement time interval M2.

In the pulsed operation, the analyser 26 in each case records a mass spectrum during the duration $\Delta t_{T1}$ of a respective first sub-interval T1 in which the ionised gas 2 is transferred into the analysis area 25, as well as during the duration $\Delta t_{T2}$ of a second sub-interval T2 that follows on. From the mass spectra of the first measurement time interval M1 recorded in the respective sub-intervals T1, T2, a resulting mass spectrum MS1 is formed through summation or averaging, which is shown in FIG. 4, at the bottom on the left. During the duration $\Delta t_T$ of corresponding sub-intervals T of a second measurement time interval M2 following the first one, likewise a number of mass spectra or a signal intensity are recorded and totalled or averaged via the number of sub-intervals T of the second measurement time interval M2, in order to form a resulting mass spectrum MS2.

The first measurement time intervals M1 thus form a signal channel K1 and the second measurement time intervals M2 form a background channel K2 of the analyser 26.

As was described further above in connection with FIG. 3, the resulting mass spectrum MS1 of the first measurement time interval M1 and the resulting mass spectrum MS2 of the second measurement time interval M2 can be compared with one another, for example by the two resulting mass spectra MS1, MS2 being subtracted from one another. In this way, even in the case of the pulsed operation of the analyser 26 which is shown in FIG. 4, the mass-to-charge ratio can be improved. As a rule, it is only expedient to compare the mass spectra MS1, MS2 of adjacent first and second measurement time intervals M1, M2 with one another. In place of the subsequent second measurement time interval M2 it would therefore also be possible to use the second measurement time interval M2 preceding the respective first measurement time interval M1 for carrying out the comparison.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A mass spectrometer for analysing a gas by mass spectrometry, comprising:

a controllable inlet system for pulsed feeding of the gas that is to be analysed from a process area outside the mass spectrometer into an ionisation area, wherein the inlet system has a tubular filter device in the form of a corrugated hose for filtering a corrosive gas, an ionisation device for ionising the gas that is to be analysed in the ionisation area, an ion transfer device for transferring the ionised gas from the ionisation area via an ion transfer area into an analysis area, and an analyser for detecting the ionised gas in the analysis area.

2. The mass spectrometer according to claim 1, in which the inlet system is temperature-controllable.

3. The mass spectrometer according to claim 1, in which the inlet system has a controllable component that can be switched between a first switching state for pulsed feeding of the gas that is to be analysed into the ionisation area and a second switching state for pulsed feeding of a carrier gas into the ionisation area.

4. The mass spectrometer according to claim 1, in which the ionisation device has an electron source that can be operated in a pulsed manner, for ionising the gas that is to be analysed, in the ionisation area.

5. The mass spectrometer according to claim 4, in which the electron source is surrounded by a heat sink that has an opening for the emergence of an electron beam.

6. The mass spectrometer according to claim 4, in which the mass spectrometer is designed to maintain a temperature of less than 100° C. in a temperature-controllable ionisation space of the ionisation device when the electron source is operated.

7. The mass spectrometer according to claim 4, in which the electron source is detachably fitted to the mass spectrometer.

8. The mass spectrometer according to claim 1, in which the ionisation device has a plasma ionisation device for producing ions and/or metastable particles of an ionisation gas.

9. The mass spectrometer according to claim 1, in which the ionisation device has a gas feed for the pulsed or continuous addition of CI gas into the ionisation area of the ionisation device.

10. The mass spectrometer according to claim 1, in which the ion transfer device has an ion transfer chamber in which the ion transfer area is formed, wherein the ion transfer chamber is connected via a diaphragm aperture to the ionisation area.

11. The mass spectrometer according to claim 1, further comprising: a pump device for creating a pressure (pA) in the analysis area and for creating a pressure (pI) in the ionisation area, wherein the pump device is designed to set the pressure (pI) in the ionisation area independently of the pressure (pA) in the analysis area.

12. The mass spectrometer according to claim 1, in which a pressure (pI) in the ionisation area is greater, by a factor of between $10^3$ and$10^6$, than a pressure (pA) in the analysis area.

13. The mass spectrometer according to claim 1, in which in the ion transfer area of the ion transfer device, a pressure (pT) prevails which lies between the pressure (pI) in the ionisation area and the pressure (pA) in the analysis area, wherein the pump device is designed to set the pressure (pI) in the ion transfer area independently of the pressure (pI) in the ionisation area and of the pressure (pA) in the analysis area.

14. The mass spectrometer according to claim 1, further comprising:

a controllable extraction device for the pulsed extraction of the ionised gas out of the ionisation area into the ion transfer area.

15. The mass spectrometer according to claim 14, in which the extraction device has an electrode arrangement for accelerating and focusing the ionised gas in the direction towards the ion transfer area.

16. The mass spectrometer according to claim 14, further comprising: a controller for the synchronised actuation of the controllable inlet system and of the extraction device, such that the extraction device does not extract any ionised gas from the ionisation area when the inlet system is closed.

17. The mass spectrometer according to claim 16, in which for the mass spectrometer analysis of the gas, the analyser is designed to compare a mass spectrum (MS1) that is recorded in at least one measurement time interval (M1) with an open inlet system to a mass spectrum (MS2) that is recorded in at least one measurement time interval (M2) with a closed inlet system.

18. The mass spectrometer according to claim 16, in which the analyser is designed for the continuous analysis of the ionised gas and in which the controller actuates the extraction device throughout the entire duration (ΔtM1) of a respective measurement time interval (M1) 5 with an open inlet system, for the extraction of the ionised gas from the ionisation area.

19. The mass spectrometer according to claim 18, in which the analyser is designed to be switchable between a signal channel (K1) and a background channel (K2) and, for the analysis of the gas, to form a resulting mass spectrum (MS1) from a number of measurement time intervals (M1) of the signal channel (K1) and to form a resulting mass spectrum (MS2) from a number of measurement time intervals (M2) of the background channel (K2), and to compare the two resulting mass spectra (MS1, MS2) of the signal channel (K1) and the background channel (K2) with one another for mass spectrometry analysis.

20. The mass spectrometer according to claim 16, in which the analyser is designed for the pulsed analysis of the ionised gas and in which the controller is designed to actuate the extraction device in a plurality of sub-intervals (T1) during a measurement time interval (M1) with an open inlet system, for the extraction of the ionised gas from the ionisation area.

21. The mass spectrometer according to claim 20, in which the analyser is designed to form a resulting mass spectrum (MS1) from a plurality of sub-intervals (T1, T2) within a measurement time interval (M1) with an open inlet system, and a resulting mass spectrum (MS2) from a plurality of sub-intervals (T) of a measurement time interval (M2) with a closed inlet system preceding or following the measurement time interval (M1), and to compare the two resulting mass spectra (MS1, MS2) with one another for mass spectrometer analysis.

22. The mass spectrometer according to claim 1, in which the analyser is selected from the group comprising: quadrupole analyser, triple quadrupole analyser, Time-of-Flight (TOF) analyser, orthogonal acceleration TOF analyser, scanning quadrupole ion trap analyser and Fourier transform ion trap analyser.

23. A method for the mass spectrometry analysis of a gas that is to be analysed by means of a mass spectrometer according to claim 1, comprising:

pulsed feeding of the gas that is to be analysed out of a process area outside the mass spectrometer into an ionisation area via an inlet system, ionising of the gas that is to be analysed in the ionisation area, pulsed extraction of the ionised gas from the ionisation area into an ion transfer area by means of an extraction device, transfer of the ionised gas out of the ion transfer area into an analysis area, and detection of the ionised gas in the analysis area for its analysis by mass spectrometry.

24. The method according to claim 23, further comprising:

actuation of the controllable inlet system and of the extraction device such that the extraction device does not extract any ionised gas from the ionisation area when the inlet system is closed.

25. The method according to claim 23, in which for the mass spectrometry analysis of the gas that is to be analysed, at least one mass spectrum (MS1) that is recorded in at least one measurement time interval (M1) with an open inlet system is compared with at least one mass spectrum (MS2) that is recorded in at least one measurement time interval (M2) with a closed inlet system.

26. A mass spectrometer for analysing a gas by mass spectrometry, comprising:

a controllable inlet system for pulsed feeding of the gas that is to be analysed from a process area outside the mass spectrometer into an ionisation area, wherein the inlet system has a tubular filter device for filtering a corrosive gas and the inlet system has a controllable component that can be switched between a first switching state for pulsed feeding of the gas that is to be analysed into the ionisation area and a second switching state for pulsed feeding of a carrier gas into the ionisation area, an ionisation device for ionising the gas that is to be analysed in the ionisation area, an ion transfer device for transferring the ionised gas from the ionisation area via an ion transfer area into an analysis area, and an analyser for detecting the ionised gas in the analysis area.

27. A mass spectrometer for analysing a gas by mass spectrometry, comprising:

a controllable inlet system for pulsed feeding of the gas that is to be analysed from a process area outside the mass spectrometer into an ionisation area, wherein the inlet system has a tubular filter device for filtering a corrosive gas, an ionisation device having an electron source that can be operated in a pulsed manner for ionising the gas that is to be analysed in the ionisation area, the electron source surrounded by a heat sink that has an opening for the emergence of an electron beamv , an ion transfer device for transferring the ionised gas from the ionisation area via an ion transfer area into an analysis area, and an analyser for detecting the ionised gas in the analysis area. in which the ionisation device has an electron source that can be operated in a pulsed manner, for ionising the gas that is to be analysed, in the ionisation area.

28. The mass spectrometer according to claim 27, in which the mass spectrometer is designed to maintain a temperature of less than 100° C. in a temperature-controllable ionisation space of the ionisation device when the electron source is operated.

29. The mass spectrometer according to claim 27, in which the electron source is detachably fitted to the mass spectrometer.

* * * * *